US008727488B2

(12) United States Patent
Lee et al.

(10) Patent No.: US 8,727,488 B2
(45) Date of Patent: May 20, 2014

(54) APPARATUS FOR CAPTURING AEROSOLS

(75) Inventors: Michael H. Lee, San Jose, CA (US); Napoleon J. Leoni, San Jose, CA (US); Henryk Birecki, Palo Alto, CA (US); Omer Gila, Cupertino, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 564 days.

(21) Appl. No.: 12/717,780

(22) Filed: Mar. 4, 2010

(65) Prior Publication Data

US 2011/0216126 A1 Sep. 8, 2011

(51) Int. Cl.
*B41J 2/165* (2006.01)

(52) U.S. Cl.
USPC ..... 347/34

(58) Field of Classification Search
None
See application file for complete search history.

(56) References Cited

U.S. PATENT DOCUMENTS

| | | | | |
|---|---|---|---|---|
| 4,013,004 | A * | 3/1977 | Watanabe et al. | 347/124 |
| 4,725,732 | A * | 2/1988 | Lang et al. | 250/326 |
| 5,338,587 | A * | 8/1994 | Mammino et al. | 430/53 |
| 5,627,376 | A * | 5/1997 | Jaisinghani et al. | 250/325 |
| 6,449,447 | B1 | 9/2002 | Regelsberger | |
| 6,668,154 | B2 | 12/2003 | Dickhoff | |
| 7,387,352 | B2 | 6/2008 | Florence | |
| 7,412,186 | B2 | 8/2008 | Sekovski | |
| 7,452,652 | B2 | 11/2008 | Detig | |
| 2007/0154245 | A1 | 7/2007 | Lee et al. | |
| 2009/0033735 | A1 | 2/2009 | Leoni et al. | |

* cited by examiner

*Primary Examiner* — Matthew Luu
*Assistant Examiner* — Alejandro Valencia

(57) ABSTRACT

Apparatus for capturing aerosols are disclosed. An example apparatus described herein includes a corona wire, and a nonconductive housing comprising a first cavity to expose a first portion of the corona wire, a second cavity to expose a second portion of the corona wire, and a chamber between the first and second cavities. A third portion of the corona wire is located within the chamber between the first and second portions of the corona wire.

14 Claims, 4 Drawing Sheets

APPARATUS FOR CAPTURING AEROSOLS

BACKGROUND

Corona discharge occurs when a sufficient voltage is applied between two conductors with an appropriate geometry to ionize a fluid, such as air, between the conductors, causing ions to flow from one of the conductors to the other. Additionally, the ions may interact with other particles in the fluid. Corona discharge has been previously used in early-generation desktop laser printers and is still used in high-speed laser-based presses and printers to apply electrostatic charge to an imaging drum.

DETAILED DESCRIPTION

Figure 1:
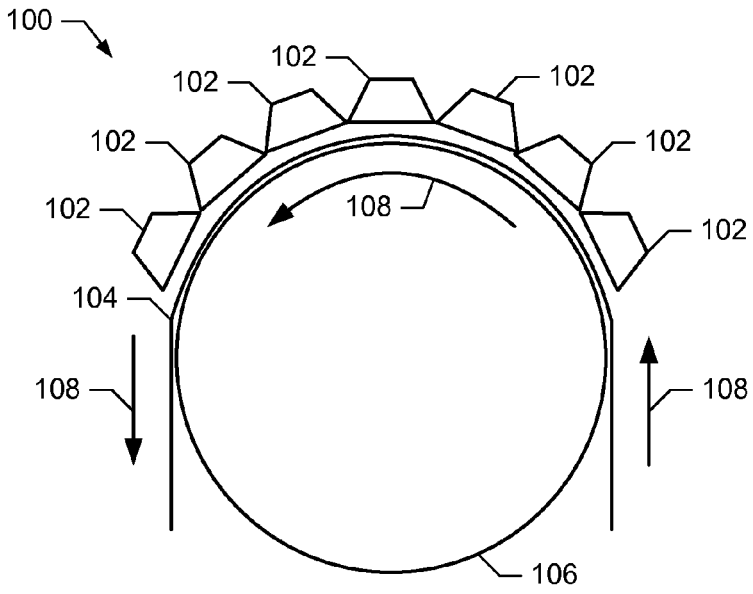
FIG. 1 depicts an example high speed web press, including several print bars, used to apply ink to a substrate, in accordance with the teachings herein.

Certain examples are shown in the above-identified figures and described in detail below. In describing these examples, like or identical reference numbers are used to identify the same or similar elements. Additionally, several examples have been described throughout this specification. Any features from any example may be included with, a replacement for, or otherwise combined with, other features from other examples. The figures are not necessarily to scale and certain features and certain views of the figures may be shown exaggerated in scale or in schematic for clarity and/or conciseness. Although the following discloses example systems and apparatus, it should be noted that such systems and apparatus are merely illustrative and should not be considered as limiting the teachings of this disclosure.

The example systems and apparatus described herein may be used to reduce or eliminate aerosols such as ink aerosols from an inkjet printer or press. Ink aerosols are tiny droplets of ink that are output from inkjet press pens but which do not land on the print substrate. Instead, the ink droplets linger in the air region between the print bar and the substrate. Aerosols may cause several problems. For example, the ink aerosols may travel with the moving air to other inkjet press pens and, thus, may alter the color output of those other inkjet press pens. Aerosols may also land on electronic components of the inkjet press, which may cause the components to be short-circuited and/or which may ignite some types of aerosols.

Traditionally, air vacuums are used to remove aerosols that do not land on the print substrate. However, an air boundary layer between the vacuum intake and the inkjet pens may not be penetrated by air vacuums and, thus, some of the aerosols may not be captured.

Example systems and apparatus described herein include a corona bar affixed to a print bar in proximity to one or more inkjet pens. In some examples, the corona bar is located directly behind each of the inkjet pens relative to the direction of print substrate travel. The corona bar forces aerosols from the air onto the print substrate to prevent any negative effects of aerosols lingering in the air.

In some examples, the corona bar includes a corona wire and a housing composed of a nonconductive material. In some examples, the housing is a rectangular channel having three nonconductive faces and one open face (e.g., a U-shaped channel). As described in more detail below, the corona wire may be disposed within the channel of the housing. The wire may be substantially centrally positioned within the open face of the housing, and/or outside the open face of the housing. A ground plane is disposed outside the corona bar opposite the open face of the corona bar, and the print substrate path travels between the corona wire and the ground plane. When a sufficient charge, potential, and/or current is applied to the corona wire, the corona wire produces ions that move toward the ground plane and the print substrate to capture aerosols and force them onto the print substrate.

In some examples, the corona wire is physically supported at one or more points along the corona wire to prevent physical vibration of the corona wire. Physical vibration may result in, for example, induced oscillatory currents in the corona wire that reduce the effectiveness of the corona wire.

In some examples, inkjet pens are arranged on a print bar in multiple rows and multiple corona bars in positions respectively corresponding to the multiple rows. In some examples where inkjet pens are spaced or offset across the surface of the print bar and, thus, the print substrate, only portions of the corona wire corresponding to areas associated with the inkjet pens are exposed to capture aerosols. The portions of the corona wire that are not exposed are concealed, for example, in chambers in the corona bar housing. The concealed portions of the corona wire may not produce ions or consume power and, therefore, contribute to increased efficiency of the corona bar. Some example corona bar housings have cross-sectional dimensions based on the location of the corona wire relative to the corona bar. For example, the cross-section of the corona bar housing may be smaller as the corona wire is positioned closer to the ground plane and the print substrate.

The example systems and apparatus described herein may be adapted to fit into smaller spaces and/or to span longer distances than previous corona wires. Further, the example systems and apparatus described herein are efficient and durable, thereby providing a relatively long operating life. The example systems and apparatus illustrated herein may also operate in a moist environment, such as a high speed inkjet press, without short-circuiting the corona wire. In some examples, a corona bar housing includes polyphenylene-based plastics that provide electrical insulation to prevent electrical short-circuiting and/or arcing and to significantly reduce the current to the corona bar, which decreases corona efficiency. While known corona wires are exposed along the entire length in the interior (e.g., between the ends) of the corona bar, some of the example corona bars described herein are not exposed over the entire length of the corona wire. Instead, some of the examples described herein only expose one or more individual areas or spans, each of which may correspond to an inkjet pen as noted above, although current flows through the entire corona wire. In between the spans, the corona wire is concealed within the housing in small, closed chambers to thereby substantially reduce power consumption in the concealed regions and decrease ozone emission. Further, physical contact between the corona wire and the housing within the chambers also suppresses or prevents vibration of the corona wire.

Some alternative example print bars described herein include a corona wire that is exposed substantially continuously across distances that may allow the wire to vibrate if unsupported. Instead of using chambers in the housing, these example corona bars use thin support structures to prevent the wire from vibrating while allowing for a substantially continuous area of the print substrate to be exposed to ions produced by the corona wire. The example support structures may be thin enough to allow the ions from the portions of the corona wire laterally adjacent the support structures to partially compensate for ions blocked in dead zones corresponding to the regions where the wire contacts the support structures.

FIG. 1 depicts an example high speed web press 100 that includes several print bars 102 used to apply ink to a print substrate 104. The print bars 102 are disposed above a roller 106, which holds the substrate 104 in a manner that enables the application of ink(s) to the print substrate 104. In the example web press 100, the print substrate 104 travels over the roller 106 in a direction indicated by arrows 108. As the substrate passes the print bars 102, the print bars 102 apply different colors and/or patterns of inks to the print substrate 104. With the exception(s) of the physical orientation(s), and/or the type(s) and/or color(s) of inks used by the different print bars 102, the example print bars 102 used in the web press 100 are substantially identical. The web press 100 is shown by way of example. Other configurations may be used to suit a particular application. For example, individual rollers may be used below each row of pens instead of the roller 106 to better control the spacing between the substrate and the pens.

Figure 2:
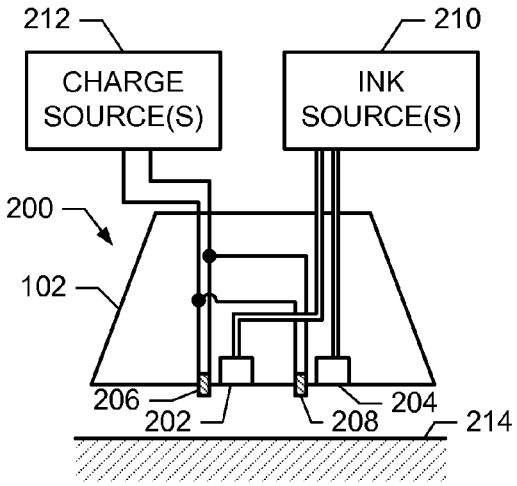
FIG. 2 depicts a more detailed diagrammatic view of an example print bar used in the web press of FIG. 1.

FIG. 2 depicts a more detailed diagrammatic view of an example print bar 200 that may be used to implement the example print bars 102 used in the web press 100 of FIG. 1. The example print bar 200 includes multiple rows 202 and 204 of inkjet pens and corresponding corona bars 206 and 208. In the direction of print substrate travel, the corona bars 206 and 208 are disposed after or behind the respective rows 202 and 204 of inkjet pens to capture aerosols emitted from the inkjet pens 202 and 204. The inkjet pens receive an ink supply from one or more ink sources 210. One or more charge sources 212 apply electrical charges or currents to corona wires in the corona bars 206 and 208. In some examples, the charge sources 212 supply an average electrical field of about 1 Volt/micrometer (V/μm) or more. To achieve such an electrical field, in these examples, the electrical charge sources 212 may apply a potential of between about 6000-8000 Volts to the corona wires with respect to a ground plane 214 beneath the print substrate 104.

Figure 3:
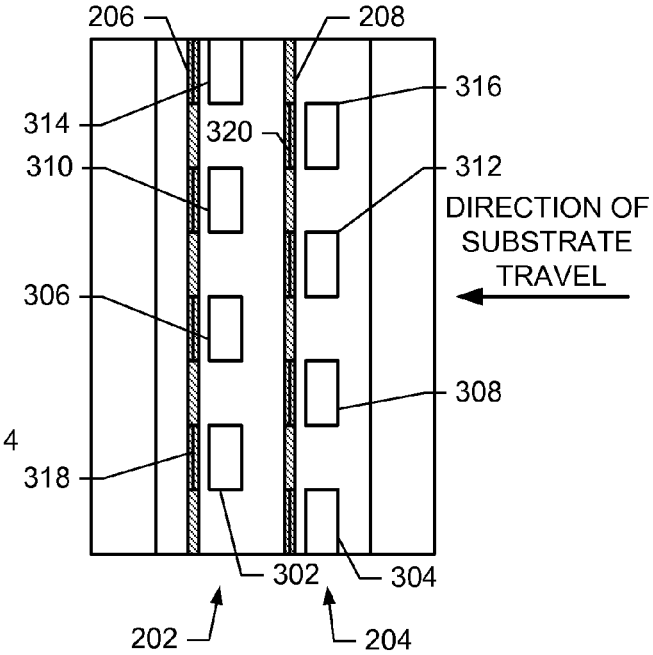
FIG. 3 depicts a bottom view of the example print bar of FIG. 2.

FIG. 3 is a bottom view of the example print bar 200 of FIG. 2. As depicted in this example, the print bar 200 includes multiple rows 202 and 204 of inkjet pens 302, 304, 306, 308, 310, 312, 314 and 316. Each of the corona bars 206 and 208 includes a respective corona wire 318 and 320. As depicted in FIG. 3, the corona wires 318 and 320 are only exposed in the areas that correspond to the inkjet pens 302, 304, 306, 308, 310, 312, 314 and 316. Further, the corona wires 318 and 320 are located behind their respective pens in the direction of print substrate travel shown in FIG. 3. Where the corona wires 318 and 320 are not exposed, the wires 318 and 320 may be recessed in or concealed by, for example, chambers in the housing of the corona bars 206 and 208.

In the illustrated example, the corona bars 206 and 208 are located behind their respective inkjet pens 302, 304, 306, 308, 310, 312, 314, and 316 relative to the print substrate travel path to capture aerosols generated by respective ones of the inkjet pens 302, 304, 306, 308, 310, 312, 314, and 316. However, in some examples the corona bars 206 and 208 may not be located immediately behind their respective inkjet pens 302, 304, 306, 308, 310, 312, 314 and 316 and may instead, for example, follow multiple rows of inkjet pens.

The example corona bars 206 and 208 of FIG. 3 include a housing as described in further detail below. The described example housings are composed of a nonconductive plastic material, such as a polyphenylene-based plastic, to prevent arcing from the high-voltage corona wires 318 and 320 to the housing and to increase efficiency by substantially increasing the proportion of the corona current directed to the ground plane and reducing the corona current lost to the corona bar. Polyphenylene-based plastics are highly resistant to water absorption, even when immersed. Thus, because the inkjet press environment subjects the corona bars 206 and 208 to humid conditions, a polyphenylene-based housing is more likely to maintain its nonconductive properties than some other materials. The surfaces of the example print bars 102 and 200 illustrated in FIGS. 1 and 2 are metal. Given the dimensions of the example corona bars 206 and 208 and the voltages applied to the corona wires 318 and 320, use of a metal housing could cause arcing between the corona wires 318 and 320 and the housing. In contrast, the example dimensions of the polyphenylene-based housing presented in the examples below provide resistance to arcing through the housing and electrical conduction across the surface of the housing.

Figure 4:
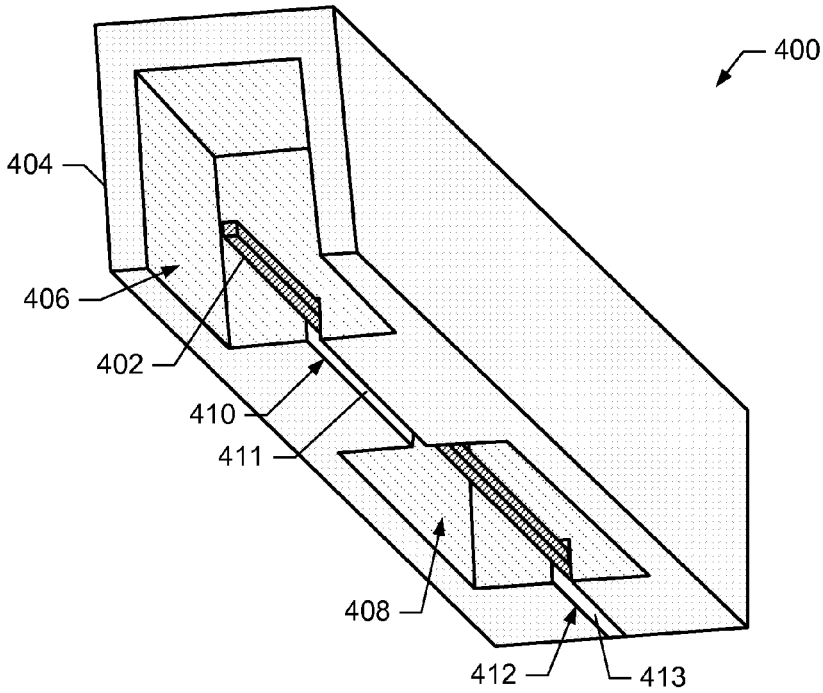
FIG. 4 depicts an example cutaway view of an example corona bar having a corona wire disposed within the corona bar housing, in accordance with the teachings herein.

FIG. 4 is a cutaway view of an example corona bar 400 having a corona wire 402 disposed within a corona bar housing 404. In some examples, the corona bar 400 is fit into a relatively small space, and the corona wire 402 may be recessed into the housing 404, thereby protecting the corona wire 402 from physical damage.

In the implementation of FIG. 4, the example housing 404 has two cavities 406 and 408 within which the corona wire 402 is exposed. The housing 404 further includes chambers 410 and 412 disposed between the cavities and, thus, the portions of the corona wire 402 disposed in the chambers 410 and 412 are concealed and/or covered. The chambers 410 and 412 include openings 411 and 413, respectively, into which the corona wire 402 may be inserted into the chambers 410 and 412.

When current is applied to the corona wire 402, the exposed portions of the corona wire 402 within the cavities 406 and 408 produce ions that capture aerosols and force the aerosols onto the print substrate. In particular, the exposed portions of the corona wire 402 are exposed to a ground potential reference and, thus, an electrical field that causes the corona wire 402 to produce ions. In contrast, the concealed portions of the corona wire 402 (e.g., the portions concealed in the chambers 410 and 412) are substantially in contact with and/or surrounded by the nonconductive housing 404 and, thus, are shielded from and/or not exposed to the ground potential reference. As a result, the concealed portions of the corona wire 402 produce few or no ions and dissipate little to no power. In some examples, the chambers 410 and 412 are further filled in (e.g., substantially sealed) with a nonconductive material (e.g., silicone) and/or covered with a nonconductive cover. As depicted in the example of FIG. 3, the cavities 406 and 408 may be disposed after or behind respective inkjet pens in the direction of print substrate travel.

Figure 5:
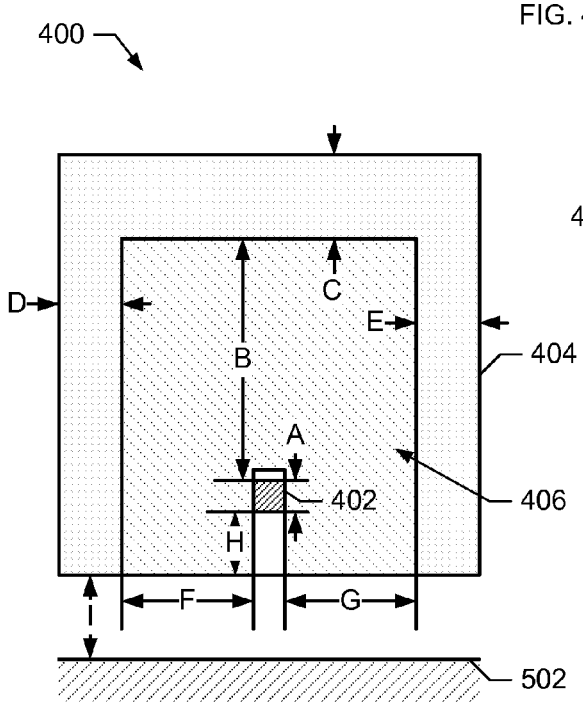
FIG. 5 depicts an example cutaway view of the example corona bar of FIG. 4, where the cut is aligned with an exposed portion of the corona wire.

FIG. 5 is a cutaway view of the example corona bar 400 of FIG. 4 illustrating an exposed portion of the corona wire 402. The example exposed portion corresponds to the cavity 406. A ground plane 502 illustrated in FIG. 5 provides a second electrode to create the corona discharge from the corona wire 402.

Corona bars used in many known solutions have larger cross-sections and are typically shorter than the example corona bar 400. Additionally, many known corona bars use conductive housing materials to establish the voltage of the corona wire. In such known corona bars, the walls of the housing are at least eight millimeters (mm) from the corona wire. In contrast, the example corona bar 400 may be substantially longer and have a smaller cross-section (e.g., less than about 10 mm×10 mm) than these known corona bars. Example dimensions that may be used to implement the example corona bar 400 are listed in Table 1 below.

TABLE 1

| Example Dimensions | |
|---|---|
| Dimension | Value |
| A | 70 μm |
| B | 5 mm |
| C | 3 mm |
| D | 1.5 mm |
| E | 1.5 mm |
| F | 3.5 mm |
| G | 3.5 mm |
| H | 2 mm |
| I | 1 mm |
| J | 0.5 mm |

Known corona wires for printers typically span distances shorter than 297 mm, the length of an A4 page, which is slightly more than that of standard 8.5 inch×11 inch page. In contrast, the example corona wire 402 may span distances close to one meter or longer.

Figure 6:
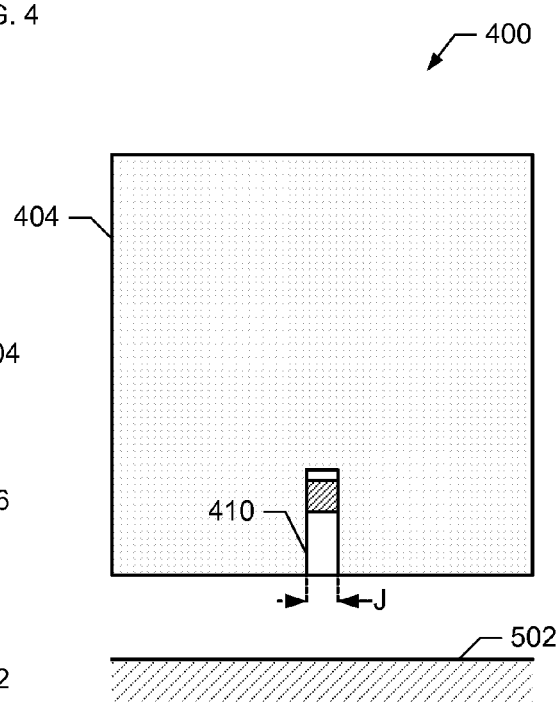
FIG. 6 depicts an example cutaway view of the example corona bar of FIG. 4, where the cut is aligned with a chamber of the corona bar housing.

FIG. 6 depicts an example cutaway view of the example corona bar 400 of FIG. 4 illustrating the chamber 410 of the corona bar 400. As illustrated in FIG. 6, the housing 404 is solid except for the chamber 410 and the corona wire 402. The example housing 404 is made of a nonconductive material and is sufficiently thick surrounding the chamber 410. As a result, contact between the housing 404 and the corona wire 402 at the voltages used in the examples noted above does not result in electrical arcing through the housing 404 or in surface conductivity to short-circuit the corona wire 402 to the print bar 102.

Figure 7:
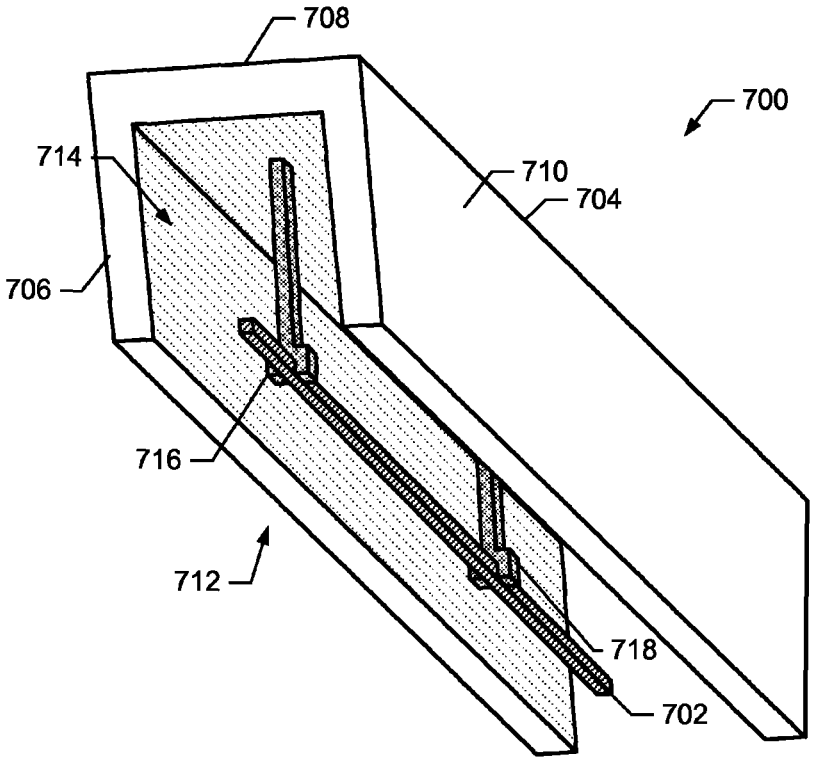
FIG. 7 depicts an example cutaway view of an example corona bar where a corona wire is disposed substantially centrally within an open face of the corona bar housing, in accordance with the teachings herein.

FIG. 7 depicts an example corona bar 700 where a corona wire 702 is disposed substantially centrally within an open face 712 of the housing 704 of the corona bar 700. As illustrated in FIG. 7, the example housing 704 includes three faces 706, 708, and 710, or walls, and the open face 712. The walls 706, 708, and 710 define a cavity 714 and the example corona wire 702 runs substantially the length of the housing 704.

In contrast to the corona bar 400 of FIG. 4, the corona bar 700 may have a smaller cross-section but the corona wire 702 is more exposed and, thus, more susceptible to physical damage. In particular, the corona wire 702 is more accessible or exposed to protruding foreign objects (e.g., during cleaning of the print bar and/or from objects protruding from the traveling print substrate) that can damage the corona wire 702. However, the configuration of FIG. 7 enables the corona wire 702 to generally be located closer to the ground plane, which may allow the corona wire 702 to function using a smaller voltage.

The example corona wire 702 spans substantially the entire distance across the print substrate. In some applications, the print substrate is relatively wide such that having the corona wire 702 span the length across the print substrate completely unsupported may result in vibration of the corona wire 702. To prevent vibration, the example corona bar 700 further includes supports 716 and 718. The supports 716 and 718 are in physical contact with the corona wire 702 and are fixed to the wall 708. Fixing the corona wire 710 to the supports 716 and 718, which are suspended from the wall 708 provides a longer path from the corona wire 702 to the print bar than, for example, mounting the corona wire in the housing as shown in FIGS. 4-6, which reduces and/or prevents surface conductivity of the housing 704 (e.g., composed of a polyphenylene-based plastic) from providing a conduction path to short-circuit the corona wire 702 to the print bar.

The example corona bar 700 includes multiple supports 716 and 718. In contrast to known corona bars, which suspend the corona wire from the ends of the corona bar, the example supports 716 and 718 contact the corona wire 702 intermediate the ends of the wire to thereby reduce and/or prevent vibration. In some examples, one or more of the supports 716 and 718 may be replaced and/or complemented by dampers that contact but may not support the corona wire 702. The number of supports used may be based on the length of the corona wire 702. In general, the number of supports and/or dampers used should be sufficient to ensure that the corona wire 702 is not physically unsupported for a distance that may result in physical vibration. However, additional supports incrementally reduce the effectiveness of the corona wire 702 due to the introduction of dead zones at points along the corona wire 702 that are in contact with the supports. Therefore, a length of corona wire 702 that is sufficiently short may not need any physical supports. In contrast, a longer corona wire 702 may need additional supports 716 and 718.

Figure 8:
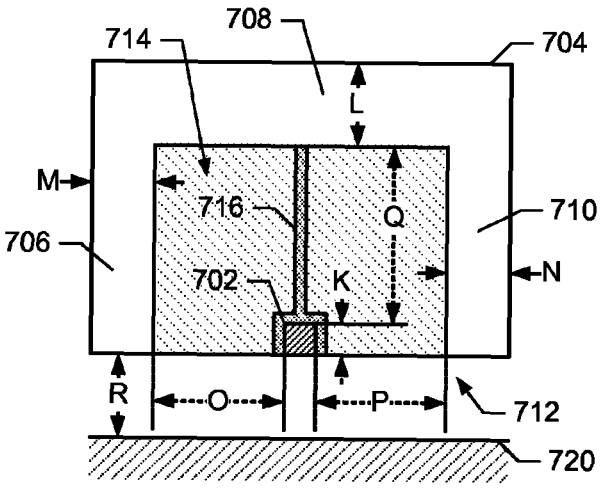
FIG. 8 depicts an example cutaway view of the example corona bar of FIG. 7.

FIG. 8 is a cutaway view of the example corona bar 700 of FIG. 7. In the view illustrated in FIG. 8, the corona wire 702, the walls 706, 708, and 710, and the support 716 are visible. The support 718 is obscured by the support 716. Because the corona wire 702 is closer to a ground plane 720 than the example corona wire 402 of FIG. 4, the cross-section of the corona bar 700 may be smaller than the cross-section of the corona bar 400. Example dimensions that may be used to implement the example corona bar 700 of FIG. 8 are provided below in Table 2.

TABLE 2

| Example Dimensions | |
|---|---|
| Dimension | Value |
| K | 70 μm |
| L | 3 mm |
| M | 1.5 mm |
| N | 1.5 mm |
| O | 1.5 mm |
| P | 1.5 mm |
| Q | 2 mm |
| R | 1 mm |

While the example walls 706 and 710 of FIG. 8 are 1.5 mm thick, the walls 706 and 710 alternatively may be as thin as 1 mm. The distance Q between the corona wire 702 and the top wall 708 may be decreased in proportion to the decrease in distance between the corona wire 702 and the walls 706 and 710. Similarly, the thickness of the top wall 708 may be decreased in proportion to the decrease in thickness of the walls 706 and 710. As a result, the cross-section of the corona bar 700 may be as small as about 5 mm×5 mm.

The example supports 716 and 718 are preferably as thin as practicable while still capable of supporting and/or preventing the corona wire 702 from vibrating. Over the portions of the corona wire 702 in contact with the supports 716 and 718, the corona wire 702 does not produce ions and dead zones may result. Therefore, those portions of the corona wire 702 in contact with the supports 716 and 718 do not contribute to capturing aerosols in the areas between such portions of the corona wire 702 and the ground plane 720. However, because the aerosols are substantially mobile, ions from portions of the corona wire 702 laterally adjacent the supports 716 and 718 may capture a significant portion of the aerosols passing through small dead zones.

Figure 9:
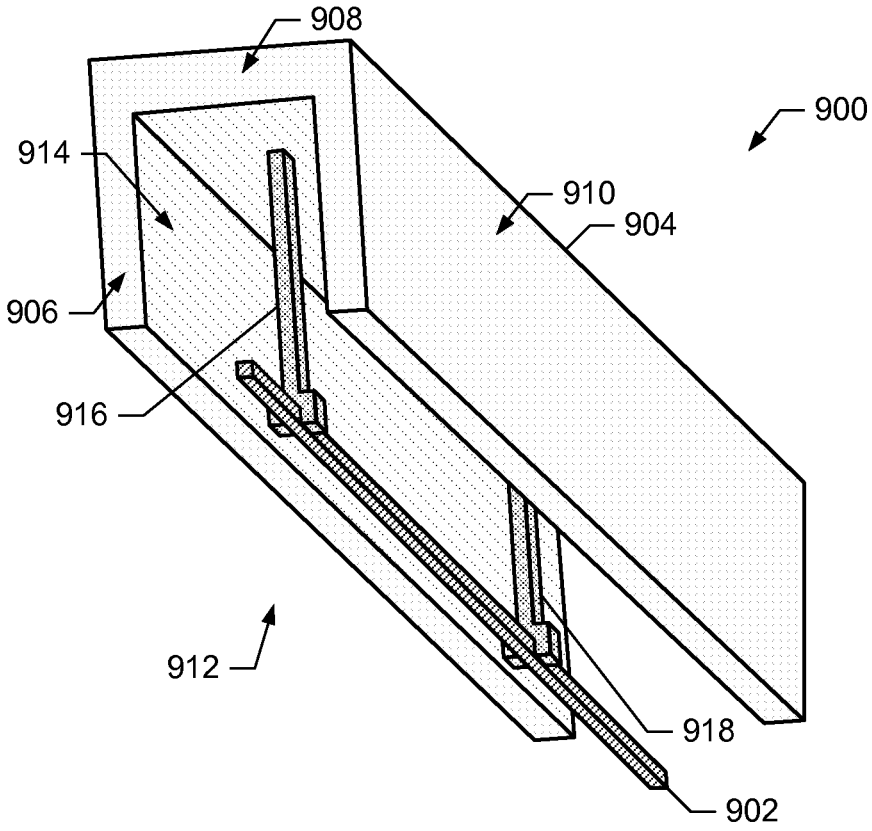
FIG. 9 depicts an example cutaway view of an example corona bar where a corona wire is disposed outside of the corona bar housing, in accordance with the teachings herein.

FIG. 9 depicts an example corona bar 900 where a corona wire 902 is disposed outside of the corona bar 900. The example corona bar 900 is similar to the corona bar 700 described in FIG. 7 and includes the corona wire 902, a housing 904 including three walls 906, 908, and 910, an open face 912, a cavity 914 and supports 916 and 918. However, the supports 916 and 918 of the corona bar 900 extend farther from the opposite wall 908 than the supports 716 and 718 of FIGS. 7 and 8 to locate and support the corona wire 902 outside of the cavity 914. The open face 912 opens toward the corona wire 902 and a ground plane 920 (illustrated in FIG. 10).

In the example configuration of FIG. 9, the corona wire 902 is more susceptible to physical damage than either of the corona wires 402 or 702 illustrated above. However, the corona wire 902 is closer to the ground plane 920 and, thus, allows the corona wire 902 to operate at a lower voltage. Additionally, the size of the housing 904 may be reduced due to the lower operating voltage.

Figure 10:
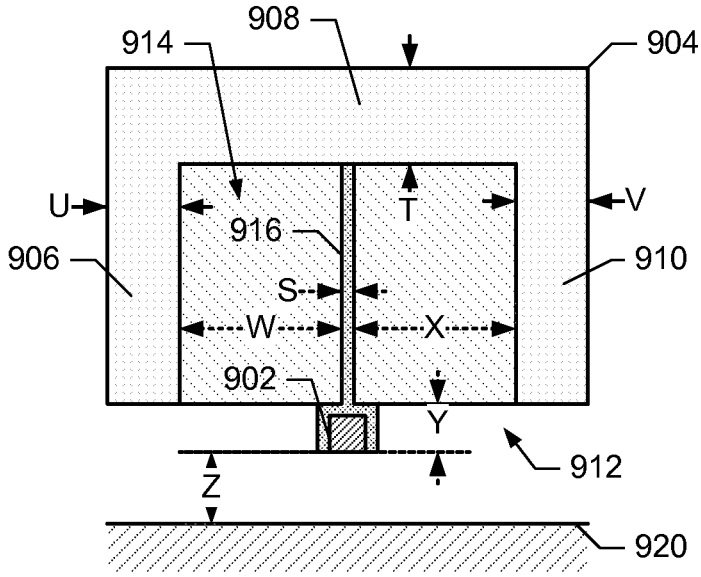
FIG. 10 depicts an example cutaway view of the example corona bar of FIG. 9.

FIG. 10 is a cutaway view of the example corona bar 900 of FIG. 9. The example dimensions listed in Table 3 below are smaller than those illustrated in FIGS. 7 and 8 due to the location of the corona bar 902 relative to the walls 906, 908, and 910, and the ground plane 920. As a result, a cross-section of the housing 904 may have, but does not necessarily have, dimensions less than about 5 mm×5 mm.

TABLE 3

| Example Dimensions | |
|---|---|
| Dimension | Value |
| S | 70 μm |
| T | 2 mm |
| U | 1 mm |
| V | 1 mm |
| W | 1 mm |
| X | 1 mm |
| Y | 0.5 mm |
| Z | 1 mm |

The example corona housing 904 of FIGS. 9 and 10 is farther away from the print substrate and the ground plane 920 than the example corona housings illustrated in FIGS. 4-8. The dimensions of Table 3 illustrate an example lower limit on the distance between the corona wire 902 and the print substrate or ground plane 920. The lower limit is representative of external factors, such as the likelihood of damage to the corona wire 902 by a deformed print substrate passing underneath. The lower limit may additionally or alternatively be representative of the distance between the aerosol source (e.g., an inkjet pen) and the print substrate. For example, if an inkjet pen is 1 mm from the print substrate, the distance from the corona bar 902 to the print substrate may have a lower limit of 1 mm. While some example external factors are considered, the external factors may be altered or removed in some other examples and the distance between the corona wire 902 and the print substrate may be modified accordingly.

Example supports 716, 718, 916, and 918 are presented in FIGS. 7-10. However, the shape(s) of the supports 716 and 718 (or dampers) are not considered to have a significant impact on the performance of the corona bar 700. Accordingly, the supports 716 and 718 may have shapes modified from those illustrated in FIGS. 7-10.

While the example corona bars 400, 700, and 900 are each illustrated having a structure for the housing including a top wall, two lateral walls, and an open face, other housing geometries are possible. Accordingly, any of the example housings 404, 704, and 904 may be modified from those illustrated in FIGS. 4-10. Similarly, the example dimensions of the housings provided in Tables 1-3 may be modified to suit particular applications.

In use, an example corona bar 400, 700, and/or 900 is mounted within a press adjacent a set of ink pens. The corona bar is then energized to drive aerosols out of the air and onto a printing substrate.

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. An apparatus to capture aerosols, comprising:

a corona wire to direct ink aerosols toward a print substrate by directing ions toward the print substrate when energized, the ink aerosols being generated by a print process; and a nonconductive housing comprising a first cavity to expose a first portion of the corona wire, a second cavity to expose a second portion of the corona wire, and a chamber between the first and second cavities, a third portion of the corona wire being located within the chamber between the first and second portions of the corona wire, the third portion being about a same length as the first portion and the third portion to produce fewer ions than the first portion when the corona wire is charged.

2. An apparatus as defined in claim 1, wherein the nonconductive housing comprises a polyphenylene-based plastic.

3. An apparatus as defined in claim 1, wherein a cross-section area of the housing has dimensions less than about ten millimeters by about ten millimeters.

4. An apparatus as defined in claim 1, wherein the corona wire is coupled to an electrical source.

5. An apparatus as defined in claim 1, wherein the nonconductive housing and the corona wire are longer than about 297 mm.

6. An apparatus as defined in claim 1, wherein the chamber includes an opening, and further comprising a nonconductive material disposed in the opening to conceal the third portion of the corona wire.

7. An apparatus as defined in claim 1, wherein the chamber is to contact the corona wire to reduce or prevent vibration of the corona wire.

8. A printer, comprising:

a corona wire to discharge ions toward a print substrate to direct ink aerosols toward the print substrate, the ink aerosols being generated by a print process;

a roller to hold a print substrate proximate to the corona wire; and a nonconductive housing comprising a first cavity to expose a first portion of the corona wire to the print substrate, a second cavity to expose a second portion of the corona wire, and a chamber between the first and second cavities, a third portion of the corona wire being located within the chamber between the first and second portions of the corona wire, the third portion being about a same length as the first portion and the third portion to produce fewer ions than the first portion when the corona wire is charged.

9. A printer as defined in claim 8, wherein the nonconductive housing comprises a polyphenylene-based plastic.

10. A printer as defined in claim 8, wherein the corona wire is coupled to an electrical source.

11. A printer as defined in claim 8, further comprising a ground plane positioned proximate to the print substrate opposite the corona wire, the corona wire to be energized with a voltage between 6000 and 8000 Volts with respect to the ground plane.

12. An apparatus as defined in claim 1, the corona wire to generate an electrical field of at least 1 Volt per micrometer.

13. An apparatus as defined in claim 1, wherein ion paths between the first portion of the corona wire and the print substrate and between the second portion of the corona wire and the print substrate are unobstructed.

14. A printer as defined in claim 8, further comprising:

a second corona wire; and a second nonconductive housing comprising a third cavity to expose a first portion of the second corona wire, a fourth cavity to expose a second portion of the second corona wire, and a second chamber disposed between the third and fourth cavities, the third cavity or the fourth cavity being positioned along a same area as the first chamber in a direction of travel of the print substrate.

* * * * *